United States Patent [19]

Tomizawa et al.

[11] 4,409,909

[45] Oct. 18, 1983

[54] PROCESS OF COMBUSTION IN A FLUIDIZED-BED INCINERATOR

[75] Inventors: Takekazu Tomizawa, Fujieda; Susumu Ueda, Shizuoka; Toyoji Sakyo, Shizuoka; Sumio Kawai, Shizuoka, all of Japan

[73] Assignee: Kabushiki Kaisha Okawara Seisakusho, Shizuoka, Japan

[21] Appl. No.: 244,721

[22] Filed: Mar. 17, 1981

[30] Foreign Application Priority Data

Mar. 20, 1980 [JP] Japan ..... 55-35383
Dec. 15, 1980 [JP] Japan ..... 55-177701

[51] Int. Cl.[3] ..... F23G 5/00
[52] U.S. Cl. ..... 110/346; 110/224; 110/245
[58] Field of Search ..... 110/224, 245, 346, 347

[56] References Cited

U.S. PATENT DOCUMENTS

| | | | |
|---|---|---|---|
| 2,026,366 | 12/1935 | Stehli | 110/224 |
| 3,888,193 | 6/1975 | Kishigami et al. | 110/245 |
| 3,888,194 | 6/1975 | Kishigami et al. | 110/245 |
| 3,926,129 | 12/1975 | Wall | 110/224 |
| 4,030,895 | 6/1977 | Caughty | 110/224 |
| 4,213,407 | 7/1980 | Headley | 110/224 |
| 4,232,614 | 11/1980 | Fitch et al. | 110/224 |
| 4,259,911 | 4/1981 | Jones | 110/245 |

*Primary Examiner*—Henry C. Yuen
*Attorney, Agent, or Firm*—Robert E. Burns; Emmanuel J. Lobato; Bruce L. Adams

[57] ABSTRACT

An incinerator for combusting sludge or the like is supplied with combustion air which is mixed with 5–40% by weight of a high-humidity, low-oxygen-concentration gas for adjustment of the excess ratio of combustion air and control over burning of nitrogen oxides in the incinerator. The gas is supplied from a predrier for drying the sludge or comprises a gas discharged from the incinerator.

5 Claims, 4 Drawing Figures

PROCESS OF COMBUSTION IN A FLUIDIZED-BED INCINERATOR

BACKGROUND OF THE INVENTION

1. Field of the Invention

The present invention relates to a process of combusting a particulate or powdery material in a fluidized-bed furnace or incinerator.

2. Prior Art

Fluidized-bed incinerators burn particulate or powdery materials such as dried sludge while being suspended in an upward stream of combustion air introduced through the bottom of the incinerator. A material to be burned is continuously fed into the incinerator in which a fluidized-bed is generated. When finely divided solids are supplied in too small an amount, no sustained combustion is possible, and conversely when the amount of the material supplied is too great, the temperature within the incinerator becomes so high that clinker is formed in the incinerator. To cope with such a problem, it has been customary to continuously detect the temperature in the incinerator and control the supplied amount of the solid material such that the interior of the incinerator will be normally in the range of from 700° C. to 1,000° C. during combustion. It is known that ordinary sludge in order to be burned with an stoichiometric amount of air should be combusted at a stoichiometric temperature of approximately from 1,600° C. to 1,800° C. It follows that to burn the solid material at a temperature ranging from 700° C. to 1,000° C., an amount of air which is about twice as much as a stoichiometric amount of air is needed resulting in a tendency for nitrogen oxides to be formed and discharged during the burning process.

SUMMARY OF THE INVENTION

Air to be introduced into a fluidized-bed incinerator for combusting sludge or the like is mixed with 5–40% by weight of a high-humidity, low-oxygen-concentration gas to thereby adjust the excess ratio of combustion air down to 1.1–1.4 and burn nitrogen oxides in the incinerator. The gas may either be supplied from a predrier which dries the sludge to be combusted in the incinerator or comprise a gas discharged from the incinerator.

It is an object of the present invention to provide a process of combustion in a fluidized-bed incinerator with control over the excess ratio of combustion air and burning of nitrogen oxides.

The above and other objects, features and advantages of the present invention will become apparent from the following description when taken in conjunction with the accompanying drawings.

DETAILED DESCRIPTION

Figure 1:
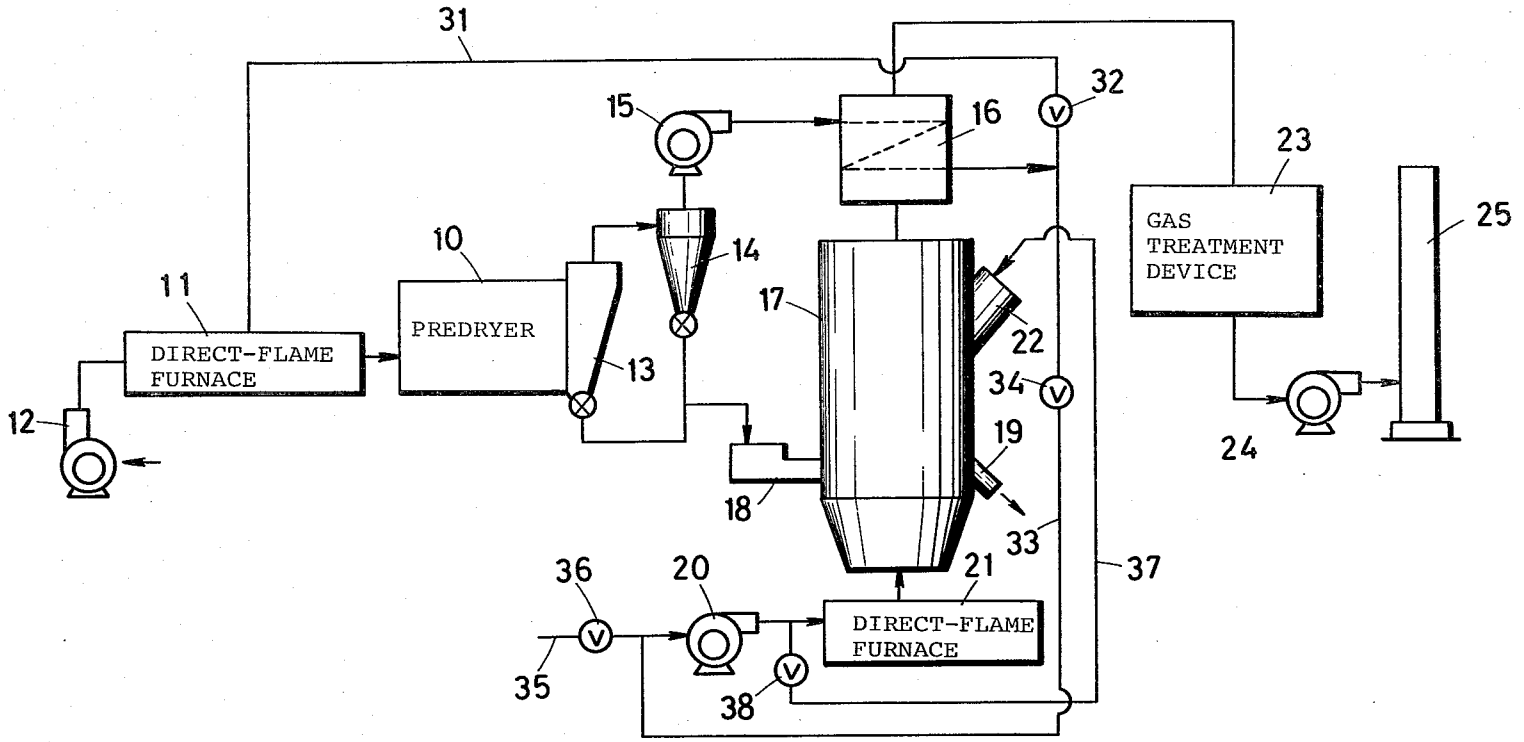
FIG. 1 is a diagram illustrative of a process according to the present invention.

As shown in FIG. 1, hot-air drier or predrier 10 is supplied with a sludgy material to be combusted which is dried therein by a hot air introduced from a direct-flame furnace 11 having a low-excess-air burner (not shown) for heating a reciculated gas (later described) and fresh air introduced from an air blower 12. The dried sludge is discharged downwardly from a duct 13 connected to the predrier 10, while at the same time a high-temperature exhaust gas is discharged upwardly from the duct 13. The discharged exhaust gas is fed into a cyclone 14 in which suspended fine particles are separated and removed from the gas. The exhaust gas is then fed into a heat exchanger 16 for being heated thereby. A portion of the heated exhaust gas from the heat exchanger 16 is fed back through line 31 controlled by valve 32 into the direct-flame furnace 11 for reciculation. By being thus recirculated, the exhaust gas is of a high temperature, a high humidity, and a low oxygen content.

Another portion of the exhaust gas fed through line 33 controlled by valve 34 is mixed with fresh air supplied by line 35 controlled by valve 36 and the mixture is fed by a blower 20 into a direct-flame furnace 21 wherein the air-gas mixture is heated before it is fed into a fluidized-bed incinerator 17 as combustion air.

The dried sludge discharged from the duct 13 together with solids from the cyclone 14 is fed through a sludge feeder 18 into the incinerator 17 wherein the sludge is combusted to produce ash which is discharged out of the incinerator 17 through an overflow outlet 19.

A portion of the air-gas mixture from the blower 20 is fed through line 37 controlled by valve 38 and is introduced into a freeboard in the incinerator 17 through an intake 22 for deodorization.

The incinerator 17 emits an exhaust gas which goes through the heat exchanger 16 wherein heat energy is transferred to the exhaust gas fed into the heat exchanger 16 from the blower 15. After having left the heat exchanger 16, the exhaust gas from the incinerator 17 goes to a gas treatment device 23 and then is forced by a blower 24 to be discharged through a chimney 25 into atmosphere.

Figure 2:
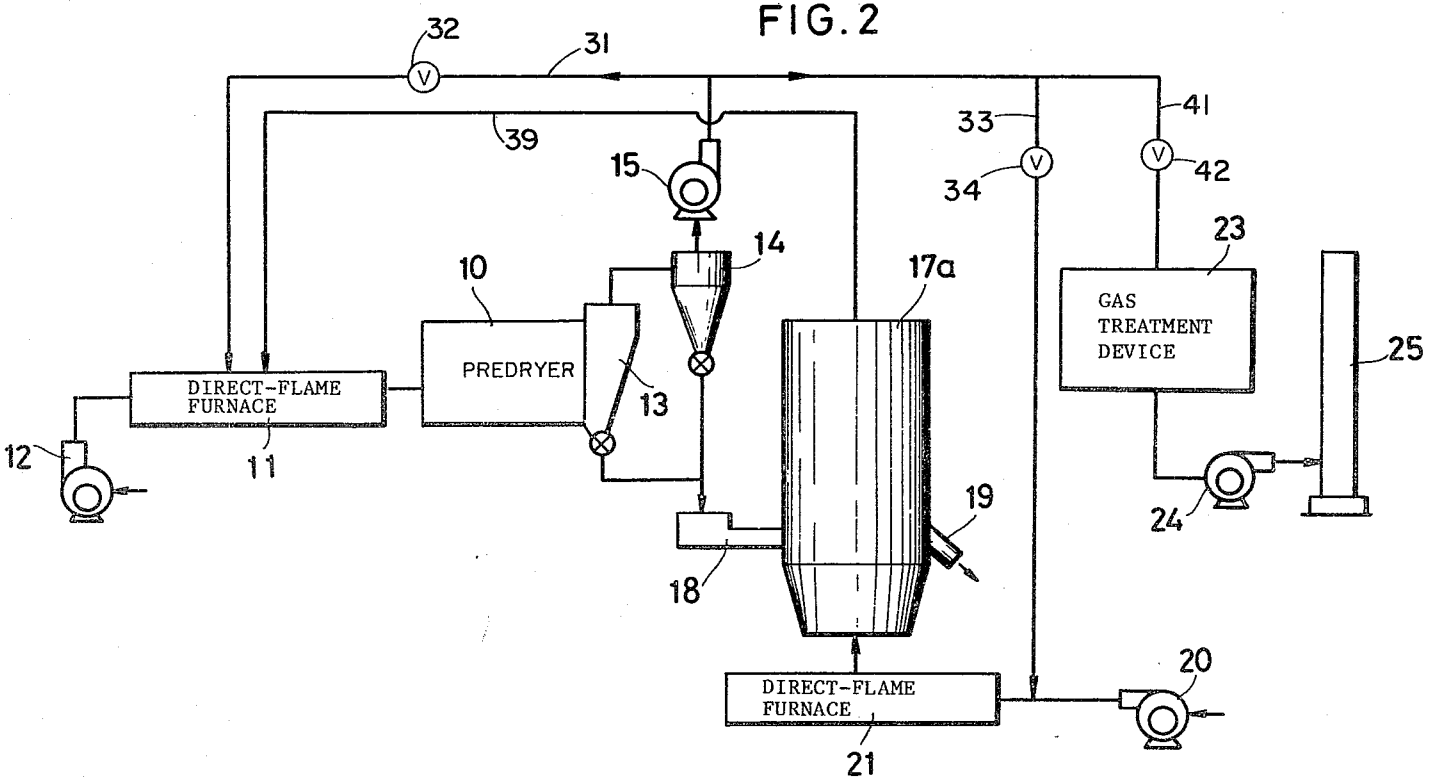
FIG. 2 is a diagram of a process according to another embodiment of the present invention.

An arrangement shown in FIG. 2 differs from that which is illustrated in FIG. 1 in that the exhaust gas from an incinerator **17*a* is entirely fed back through a line 39 to the direct-flame furnace 11 for recirculation, and the exhaust gas from the cyclone 14 goes partly through line 31 controlled by valve 32 to the direct-flame furnace 11, partly through line 41 controlled by valve 42 to the gas treatment device 23 for being discharged into atmosphere via the chimney 25 and partly through line 33 controlled by valve 42 to the direct-flame furnace 21 for introduction into the incinerator 17*a* as mixed with fresh air from the blower 20. Therefore, part of the exhaust gas from the incinerator 17*a*** is recirculated as combustion air into the latter.

Figure 3:
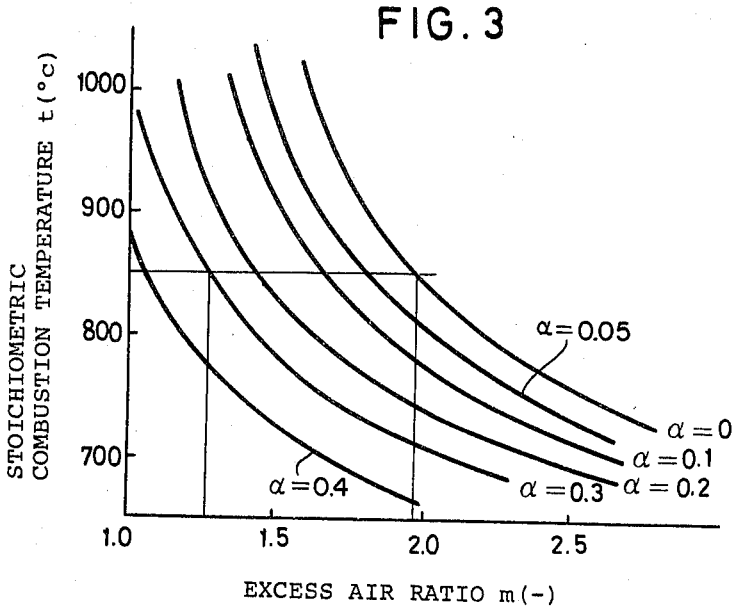
FIG. 3 is a graph showing the stoichiometric combustion temperature as a function of air ratio.

FIG. 3 shows relationships between an excess air ratio and a stoichiometric combustion temperature in the incinerator when combusting sludge. As an example, the sludge is dried by the predrier 10 until the material has a water content of 15% on a dry base. The high-humidity low-oxygen-concentration gas to be mixed with air is obtained from an exhaust gas produced when the sludge is dried, the gas having a humidity of 0.75 Kg $H_2O$/KG Air, an oxygen concentration of 0%, and being heated at a temperature of 200° C. Designated at $\alpha$ is a ratio of mixture of the high-humidity, low-oxygen-concentration gas to the air introduced by the blower 20. When no high-humidity, low-oxygen-concentration gas is mixed with the air, that is, the combustion air does not contain an excess water content and has an oxygen concentration of 20% ($\alpha=0$), the sludge is caused to blaze in the incinerator at a rapid rate. In this instance, it is necessary to keep an excess ratio of combustion air at 2.0 in order to maintain the interior of the incinerator at a temperature of 850° C.

When the air is mixed with 30% by weight of the high-humidity, low-oxygen-concentration gas, producing combustion air having a humidity of 0.25 Kg $H_2O$/Kg Air and an oxygen concentration of 14% ($\alpha=0.3$), the sludge is burned moderately with a long red flame. The sludge particles are caused to be thermally decomposed before they are burned for uniform temperature distribution. The high-humidity, low-oxygen-concentration gas thus mixed acts to deprive the incinerator interior of heat, keeping incinerator interior at a temperature substantially lower than is the case where $\alpha=0$. In the illustrated example, it has been possible to lower the excess combustion air ratio down to 1.25 while maintaining the interior of the incinerator at a temperature of 850° C.

With the arrangement of the present invention, the excess ratio of combustion air can be lowered down preferably to 1.1–1.4 by mixing a high-humidity, low-oxygen-concentration gas with supplied air. An additional advantage accruing from the arrangement of the present invention is that with the amount of material to be combusted being controlled to maintain a constant combustion temperature in the incinerator, an increase in the mixture ratio of the high-humidity, low-oxygen-concentration gas results in an increased amount of combustion disposal (K cal/$m^2$·hr). Furthermore, a material having a high calorific value which has been difficult to burn satisfactorily can be combusted at a relatively low temperature with a low excess ratio of combustion air.

Figure 4:
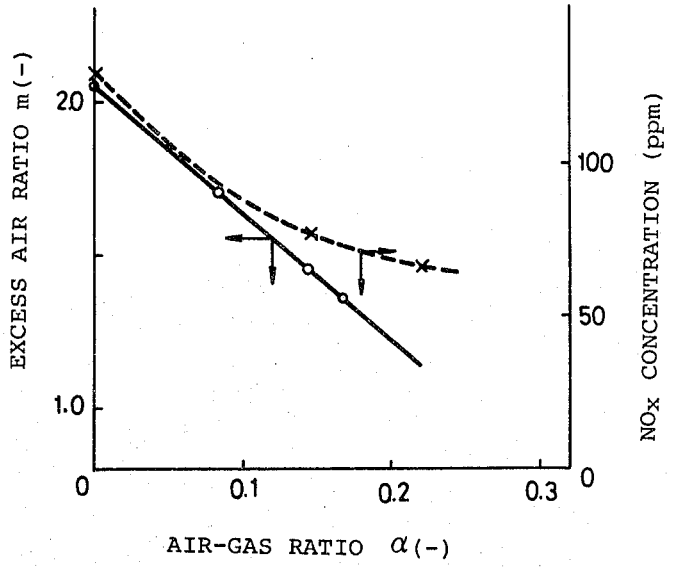
FIG. 4 is a graph showing an air ratio and a $NO_x$ concentration as a function of mixture ratio.

FIG. 4 is illustrative of an example in which the incinerator while in operation is interiorly maintained at a temperature of 850° C., the excess air ratio and the $NO_X$ concentration in a discharge smoke from the chimney 25 being plotted as functions of the air-gas ratio. The solid line curve indicates that the excess combustion air ratio decreases as the mixture ratio of the high-humidity, low-oxygen-concentration gas is increased with respect to the supplied air. As shown by the broken line curve in FIG. 4, the $NO_X$ concentration in the smoke emission is reduced in response to lowering of the mixture ratio.

Although certain preferred embodiments have been shown and described in detail, it should be understood that many changes and modifications may be made therein without departing from the scope of the appended claims.

What is claimed is:

1. A process of combustion of particulate or powdery materials such as dried sludge, which comprises feeding said material to a predrier in which said material is dried by hot combustion products of a direct flame furnace to produce predried material and high-humidity low oxygen content exhaust gas, discharging said predried material from said predrier to a fluidized-bed incinerator, separately supplying to said incinerator an air-gas mixture comprising air and from 5–40% by weight of said high-humidity low oxygen content exhaust gas from said predrier, to thereby adjust the excess ration of combustion air and burn nitrogen oxides in the incinerator.

2. A process according to claim 1, in which a portion of the exhaust gas from said predrier is supplied to said direct flame furnace.

3. A process according to claim 1 or 2 in which the exhaust gas from said predrier is heated in a heat exchanger by combustion products of said incinerator.

4. A process according to claim 1 in which air and exhaust gas from said predrier are fed into a second direct-flame furnace in which the air-gas mixture is heated before being fed into the fluidized bed furnace as combustion air.

5. A process according to claim 1, in which exhaust gas from said predrier is passed through a cyclone which removes therefrom solids which are fed to said incinerator with said predried material.

* * * * *